US009721486B2

(12) United States Patent
Yoon et al.

(10) Patent No.: US 9,721,486 B2
(45) Date of Patent: Aug. 1, 2017

(54) FRAME PANEL FOR THREE-DIMENSIONAL SIGN BOARD

(71) Applicants: Kwang Yrul Yoon, Incheon (KR); Sang Moo Lee, Incheon (KR)

(72) Inventors: Kwang Yrul Yoon, Incheon (KR); Sang Moo Lee, Incheon (KR)

(73) Assignee: SEOUL LASER DIEBOARD SYSTEM CO. LTD., San Diego, CA (US)

( * ) Notice: Subject to any disclaimer, the term of this patent is extended or adjusted under 35 U.S.C. 154(b) by 0 days.

(21) Appl. No.: 15/021,676

(22) PCT Filed: May 15, 2014

(86) PCT No.: PCT/KR2014/004357
§ 371 (c)(1),
(2) Date: Mar. 11, 2016

(87) PCT Pub. No.: WO2015/037810
PCT Pub. Date: Mar. 19, 2015

(65) Prior Publication Data

US 2016/0225295 A1 Aug. 4, 2016

(30) Foreign Application Priority Data

Sep. 11, 2013 (KR) ..... 10-2013-0108906

(51) Int. Cl.
*G09F 13/04* (2006.01)
*G09F 13/22* (2006.01)

(52) U.S. Cl.
CPC ..... *G09F 13/0404* (2013.01); *G09F 13/22* (2013.01); *G09F 2013/222* (2013.01)

(58) Field of Classification Search
CPC . G09F 13/0404; G09F 13/22; G09F 2013/222
See application file for complete search history.

(56) References Cited

U.S. PATENT DOCUMENTS 3,760,552 A * 9/1973 Skoetsch ..... G09F 13/0404 40/552
3,937,384 A * 2/1976 Minogue ..... G09F 7/14 156/153
4,097,632 A * 6/1978 Minogue ..... G09F 7/14 156/153
2002/0104241 A1* 8/2002 Grate ..... G09F 13/0404 40/552

(Continued)

*Primary Examiner* — Gary C Hoge
(74) *Attorney, Agent, or Firm* — Procopio, Cory, Hargreaves & Savitch LLP

(57) ABSTRACT

A frame panel for a three-dimensional sign board, a three-dimensional sign board including the panel, and a manufacturing method therefor. The frame panel includes a band-shaped frame panel which is cut into a predetermined length and wound in the form of a coil so that the frame panel can be bent and shaped into a desired pattern such as a character; and hitch units on which an upper panel is fixated, which are formed along the longitudinal direction of the frame panel and which are spaced apart from each other on two ends of one side of the frame panel. The hitch units are made of a soft synthetic resin material, which is the same material as used for the upper panel.

16 Claims, 5 Drawing Sheets

(56) References Cited

U.S. PATENT DOCUMENTS

| | | | | |
|---|---|---|---|---|
| 2005/0005746 | A1* | 1/2005 | Linenberger | B21D 11/08 83/39 |
| 2015/0170553 | A1* | 6/2015 | Lim | G09F 7/16 428/167 |

* cited by examiner

FRAME PANEL FOR THREE-DIMENSIONAL SIGN BOARD

CROSS-REFERENCE TO RELATED APPLICATIONS

This application is a national stage application of PCT Application No. PCT/KR2014/004357, filed on May 15, 2014. The PCT application claimed priority of Korean Patent Application No. 10-2013-0108906, filed on Sep. 11, 2013. Benefits of priority of the above-referenced applications are hereby claimed, and the disclosures of the above-referenced applications are incorporated in its entirety herein.

BACKGROUND

Field of the Disclosure

The present disclosure relates to frame panels, and more particularly, to frame panels for a three-dimensional sign board.

Background

Three-dimensional signage displays are installed to inform the consumers of the name and nature of the businesses. Thus, the signage displays enable the consumers to easily recognize and understand the nature of the businesses. The signage displays include illumination means to easily identify the businesses during the day as well as night time.

A conventional three-dimensional signage display 100 is described with reference to FIG. 1A. The conventional three-dimensional signage display 100 includes a side frame 120 with a tubular opening, an upper panel 130 which rests on top of the side frames, an upper cover 135 for covering the side frame 120 and the upper panel 130, and a base module 140 which includes an illumination portion 160.

As shown in FIG. 1B, the side frame 120 includes a tab 125 for fixing the upper panel 130 and the base module 140. The tab 125 is formed either by bending it integrally with the side frame 120 or by using the injection molding or extrusion method.

Afterwards, a bonding method including welding method, "Taka" method, or silicon resin adhesion method can be used to fix the upper panel 130 to the side frame 120.

The above method has the advantage of providing a clean interior to lock out any outside impurities from seeping in. However, since the welding or adhesion must be done within the corner of the crammed space of the interior of the side frame, it would require a person skilled in the welding/adhesion operation to perform the work. Thus, the difficult working environment causes defects and lead to increase in labor cost and decrease in productivity.

Although the "Taka" method may provide a relatively easier process, mechanically attaching through the upper panel and the tab may crack or break the hard acrylic surface of the upper panel.

In the case of the bonding method, since the metallic material of the side frame and the polymer material of the upper panel are incompatible in terms of physical properties, it may cause poor adhesion problem as well as decrease in the product reliability.

Further, since all methods may involve outdoor three-dimensional signage displays which are exposed to repeated fluctuations of high and low temperatures, mutually fixed tab (e.g., metallic) and the upper panel (e.g., polymer) with different thermal expansion coefficients may twist or break apart from each other.

The problems described above not only caused deterioration of the three-dimensional signage display itself, but the problems also caused water or other foreign objects to seep in between the gaps caused damages to and malfunctioning of the illumination portion.

Further, in the conventional three-dimensional signage display, since the corner where the upper panel is attached to the tab is integrally formed with the side frame with metallic material, the light radiating from the illumination portion is obscured by the tab. Accordingly, this may cause the periphery of the three-dimensional signage display to block the light and appear dark.

The conventional side frame, on the other hand, was molded with a desired pattern before being coated with a desired color.

However, coating the narrow interior of the side frame to seal the outside of the side frame separately took a long time and reduced productivity.

SUMMARY

The present disclosure provides for controlling variation of shape and transparency of an aperture module.

In one implementation, a three-dimensional signage display is disclosed. The display includes: a frame panel having a predetermined width, the frame panel configured to be bent and shaped into a side frame with a desired pattern; an upper panel configured to cover a first opening of the side frame; and at least one tab formed along a longitudinal direction of the frame panel, wherein the at least one tab is formed with same material as the upper panel.

Other features and advantages of the present disclosure should be apparent from the present description which illustrates, by way of example, aspects of the disclosure.

BRIEF DESCRIPTION OF THE DRAWINGS

The details of the present disclosure, both as to its structure and operation, may be gleaned in part by study of the appended further drawings, in which like reference numerals refer to like parts, and in which.

DETAILED DESCRIPTION

Figure 1A:
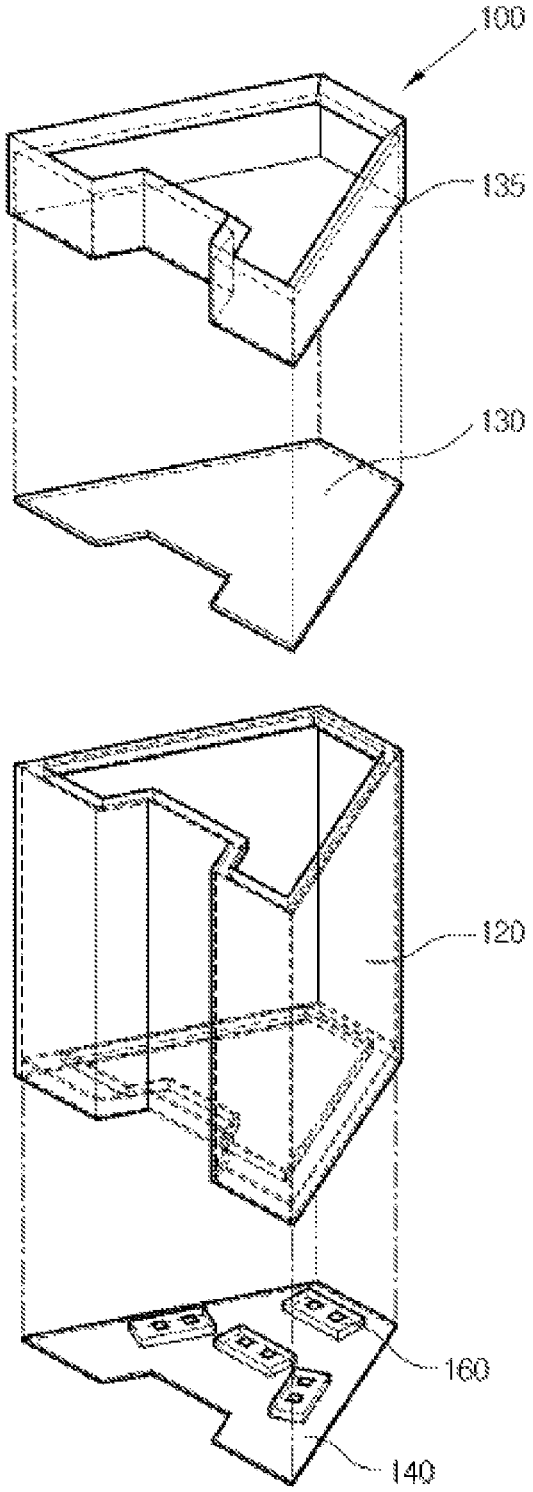
FIG. 1A is an exploded perspective view of a conventional three-dimensional signage display.

In view of the issues described above regarding conventional three-dimensional signage displays, there is a need for finding material that would allow the parts of the display to combine without the problems described above.

In one embodiment, using the tabs formed with polymer material, which is the same material as used for the upper panel, can significantly improve the adhesive strength and air tightness when attaching the tabs and the upper panel to each other. This will also prevent distortion or separation of the tabs due to different coefficients of thermal expansion. Further, the process of building the signage using the frame panel in accordance with the present disclosure further improves the problems described above.

In another embodiment, the tabs are made with material that prevents light from escaping through the periphery of the upper panel to address the light occlusion issue In yet another embodiment, since the entire panel is coated or painted in advance before the side frame is formed into a desired pattern, the coating can be facilitated, thereby improving workability, and working hours can be reduced because it is not necessary to perform individual coatings after the panel is bent to form the side frame.

In a further embodiment, the sign frame panel is provided in a strip-type panel having a predetermined width and is cut to a certain length. The sign frame panel is wound into a coil shape, which can be molded into a curved pattern of characters. The opposite ends of the sign frame panel are spaced apart from each other at a predetermined distance and the sign frame panel is formed along the longitudinal direction of the sign frame panel. The tabs are fixed and attached to the upper panel with the polymer material to prevent separation or warping of the upper panel due to the thermal expansion or contraction.

The above-described frame panel is painted with a selected color on both sides prior to attaching the tabs. The tabs can be provided with transparent material.

In another embodiment, the frame panel is cut to a predetermined length and bent to a pattern including characters and figures. The upper panel is fixed to the front opening of the side frame and has a shape corresponding to the curved pattern. The upper panel is formed with a transparent polymer material. The signage display can also include a base panel that has a shape corresponding to the curved pattern and is fixed to the rear opening of the side frame. The base panel may be formed with a dark material (as opposed to the transparent material of the upper panel) to prevent the light from escaping through the back and cause unwanted blurring or halo effect to the pattern. The lighting unit is provided on the base panel to radiate light towards the upper panel. The signage display also includes tabs which extend along the inner periphery of the openings of the side frame and fix the upper panel and the base panel. The signage display also includes attaching means for fixing the outer periphery of the upper panel and the base panel to the tabs.

The upper panel comprises one of polycarbonate or acrylic. The tab may be comprised of a polyvinyl chloride (PVC) material.

The attaching means may comprise one of adhesive tape, silicone, or epoxy.

In one embodiment, the present disclosure describes a frame panel 10 (see FIG. 2A) for the three-dimensional signage display 1 (see FIG. 4) and a method (see FIG. 5) for producing the three-dimensional signage display.

Figure 2A:
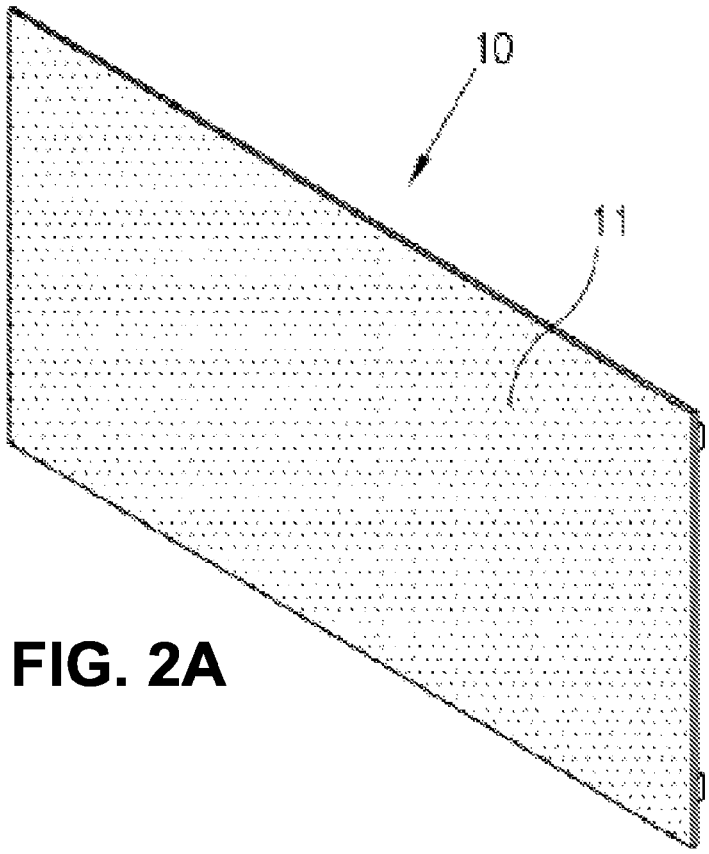
FIG. 2A is a perspective view of an outer surface of a three-dimensional sign frame panel in accordance with one embodiment of the present disclosure.
Figure 2B:
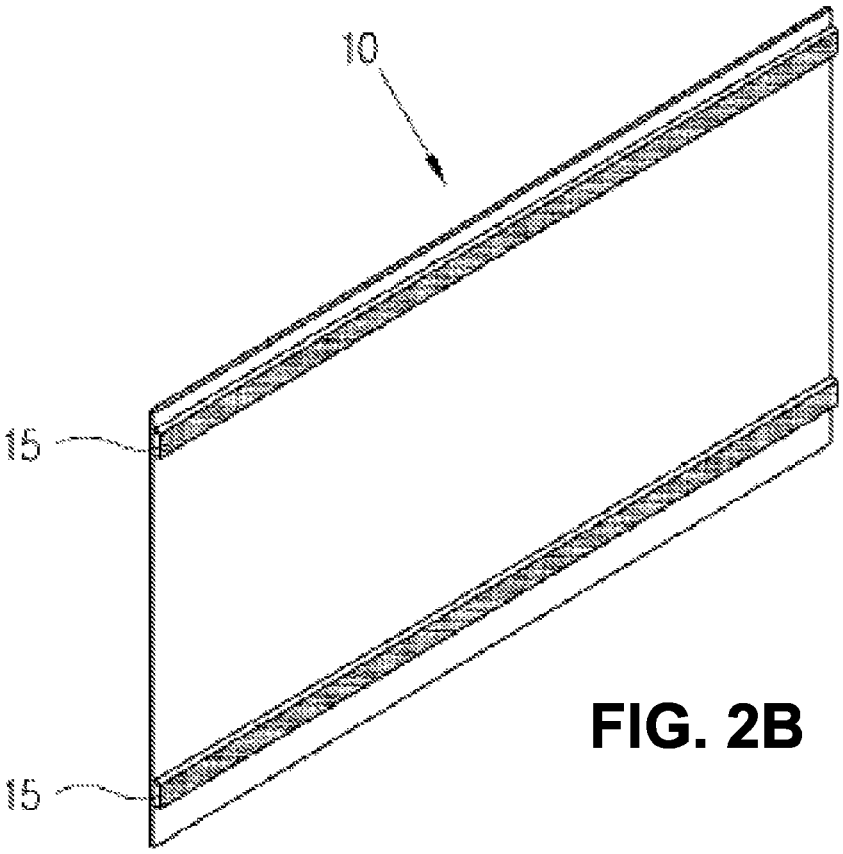
FIG. 2B is a perspective view of an inner surface of a three-dimensional sign frame panel in accordance with one embodiment of the present disclosure.
Figure 3:
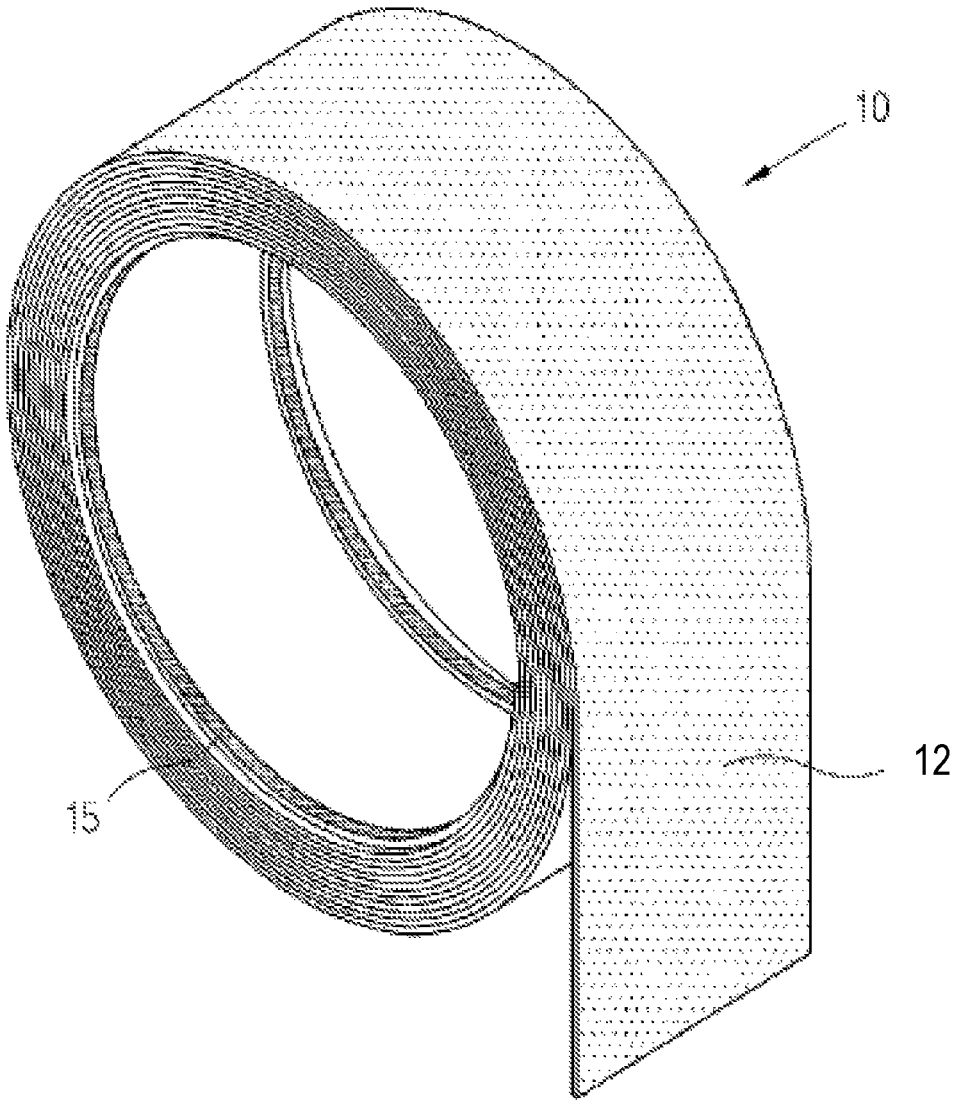
FIG. 3 is a perspective view of a three-dimensional sign frame panel wound in a coil form in accordance with one embodiment of the present disclosure.

FIGS. 2A, 2B, and 3 show the frame panel 10 for a three-dimensional signage display having a predetermined width in accordance with one embodiment of the present disclosure. In FIG. 2B, a tab 15 made of the polymer material is attached at each end of the frame panel 10 at a mutually predetermined distance in the formation along the length of the frame panel 10. FIG. 2A shows the frame panel 10 as a strip-shaped panel 11. FIG. 3 shows the frame panel 10 as a wound coil form 12.

Figure 4:
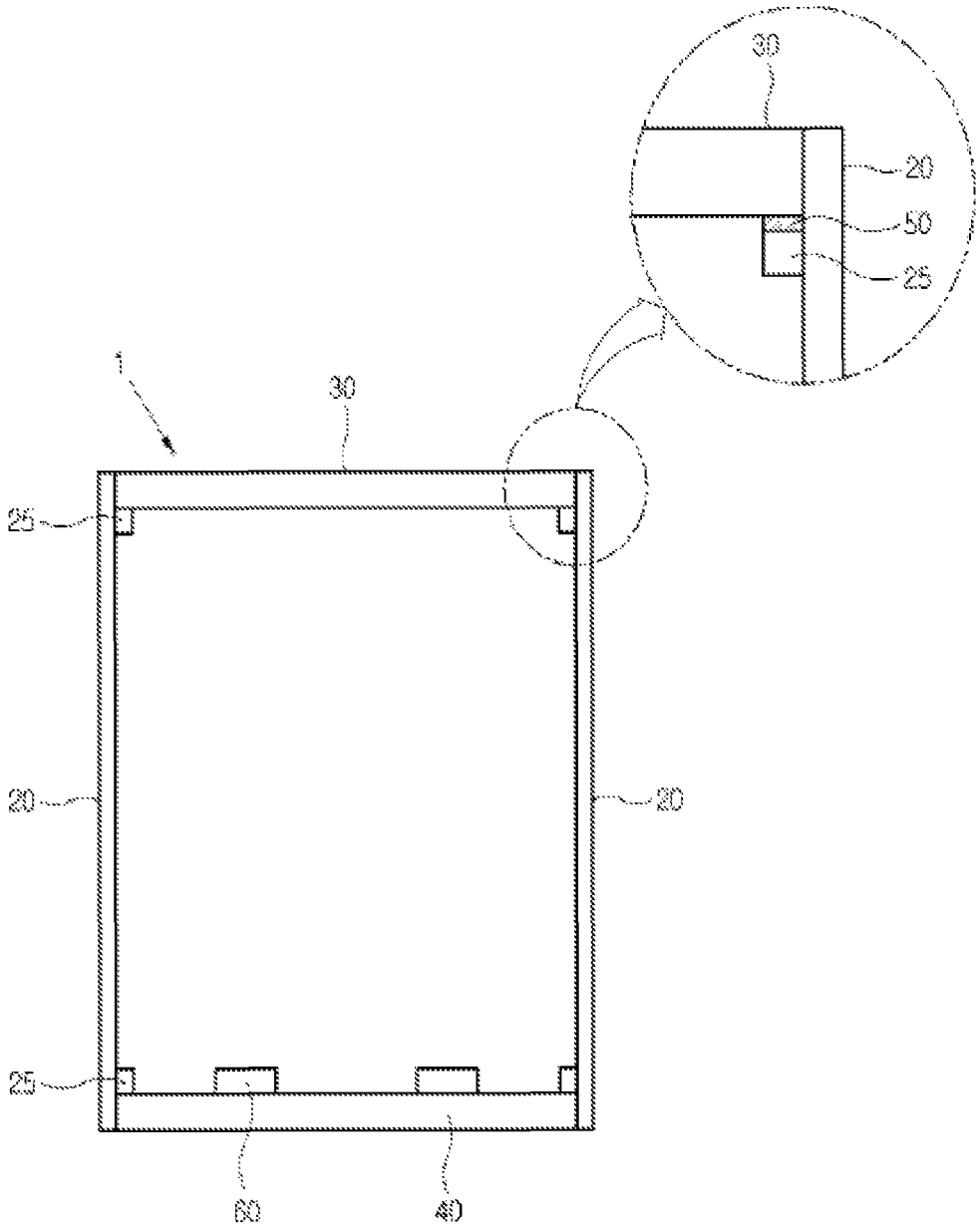
FIG. 4 is a cross-sectional view of an assembled three-dimensional sign in accordance with one embodiment of the present disclosure.

In one embodiment, the frame panel 11 is folded into a curved pattern to form the side frame 20 of the three-dimensional signage display 1 (see FIG. 4). Thus, the width of the frame panel 11 can be varied in accordance with the thickness of the three-dimensional signage display to be produced.

In another embodiment, the frame panel 11 may be made of a variety of materials. In general, the frame panel 11 is made of metallic material.

In another embodiment, since the frame panel 11 is painted with a preset color before coupling the tabs 15, the outer surface of the frame panel 11 in FIG. 2A is painted in various colors according to the selection. The inner surface shown in FIG. 2B is generally painted in white. If the inner surface of the frame panel shown in FIG. 2(*b*) is not painted, the corrosion resistance can be decreased and the lighting unit 60 (see FIG. 4) can fail.

In one embodiment, the frame panel of the three-dimensional signage display is uniformly painted while the frame panel is in a panel state before the side frame is formed into a desired pattern. This provides an advantage of shortening the work time and removing the need to paint the side frame after bending.

In one embodiment, the tabs 15 are formed on either or both end portions in the longitudinal direction of the frame panel 10 as shown in FIG. 2B.

In one embodiment, the tab 25 of FIG. 4 is formed with a variety of materials, but it is preferably formed with polymer material corresponding to material of the upper panel 30 to which the tab 25 would later be attached.

Therefore, in one embodiment, the tab 25 and the upper panel 30 being both made of the same polymer material can significantly improve the adhesive strength and air tightness. This will also prevent distortion or separation due to different coefficients of thermal expansion. This also increases the durability of the three-dimensional signage display and prevents accidents due to water damage or introduction of foreign materials.

In one embodiment, the tab 25 is formed with a soft polymer for the attachment of the tab 25 to the side frame 20 and to provide ease of the subsequent bending. However, the tab 25 can be formed with either the soft or hard polymer materials.

Further, the tab 25 is made of transparent material so that the corner portion of the three-dimensional signage display 1 where the tab 25 is located does not block the light. This further improves the visibility of the signage display.

The frame panel 10 shown in FIG. 3 can be cut to a predetermined length to form a pattern wherein the frame panel 10 is provided in a wound coil configuration.

FIG. 4 shows a three-dimensional signage display 1 according to one embodiment of the present disclosure. In FIG. 4, the three-dimensional signage display 1 includes a side frame 20, an upper panel 30, a base panel 40, a lighting unit 60, and attaching means 50 (shown in an insert).

The side frame 20 is cut to a length set to the frame panel to form a curved pattern including characters and figures. In the present disclosure, the side frame 20 as shown in FIG. 4 refers to the state in which the frame panel is cut to a desired length and bent to a curved pattern. Thus, the side frame 20 is a state before the tab 25 is attached, but is coated with the paint (i.e., the state of the frame panel). Therefore, no additional painting is necessary.

In contrast to the side frame 20, the frame panel 11 does not need to have the tab 25 attached to it using methods such as bending or injection.

Figure 1B:
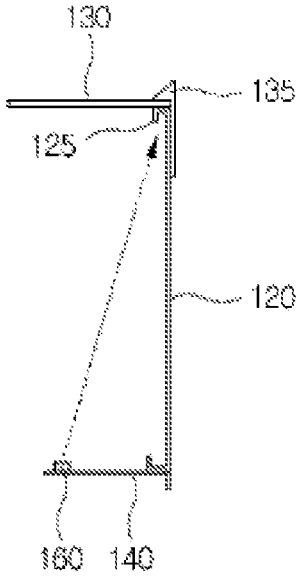
FIG. 1B is an assembled section view of a conventional three-dimensional signage display.

The pattern may be provided in the form of various types of letters, numbers, or the like in a three-dimensional shape. For example, a character similar to character 'A' shown in FIG. 1 can be formed, and in that case, the side frame 20 is in a tubular shape with an opening at both ends.

The tabs 25 may project out to form the outer circumference of the upper panel 30 and the base panel 40. The tabs 25 are fixed along the inner periphery of the opening ends of the side frame 20.

In one embodiment, the tab 25 is formed with a variety of materials, but it is preferably formed with polymer material corresponding to material of the upper panel 30 to which the tab 25 would later be attached.

Therefore, in one embodiment, the tab 25 and the upper panel 30 being both made of the same polymer material can significantly improve the adhesive strength and air tightness. This will also prevent distortion or separation due to different coefficients of thermal expansion. This also increases the durability of the three-dimensional signage display and prevents accidents due to water damage or introduction of foreign materials.

In one embodiment, the upper panel 30 is formed with either polycarbonate or acrylic material. The tab 25 can be formed with polyvinyl chloride (PVC) material.

Further, the tab 25 is made of transparent material so that the corner portion of the three-dimensional signage display 1 where the tab 25 is located does not block the light. This further improves the visibility of the signage display.

The upper panel 30 has a shape corresponding to the pattern and is formed with a transparent polymer material. The upper panel 30 is attached to the opening of the side frame 20 that is facing the front with respect to the viewer.

The base panel 40 has a shape corresponding to the pattern, and is attached to the other opening of side frame 20. The base panel 40 may be formed with the same or different material as the upper panel 30.

The illuminating unit 60 is configured on the base panel 40 and emits the light toward the upper panel 30.

The illuminating unit 60 may be configured with various types of light sources including, for example, a light-emitting diode (LED).

The attachment means 50 fixes the outer perimeter of the upper panel 30 and the base panel 40 to the tabs 25.

The attachment means 50 may include various types of material including, for example, adhesive tapes and silicon or epoxy.

The attachment means 50 is preferably made of transparent material so that the light blocked by the periphery of the upper panel 30 is minimized.

Figure 5:
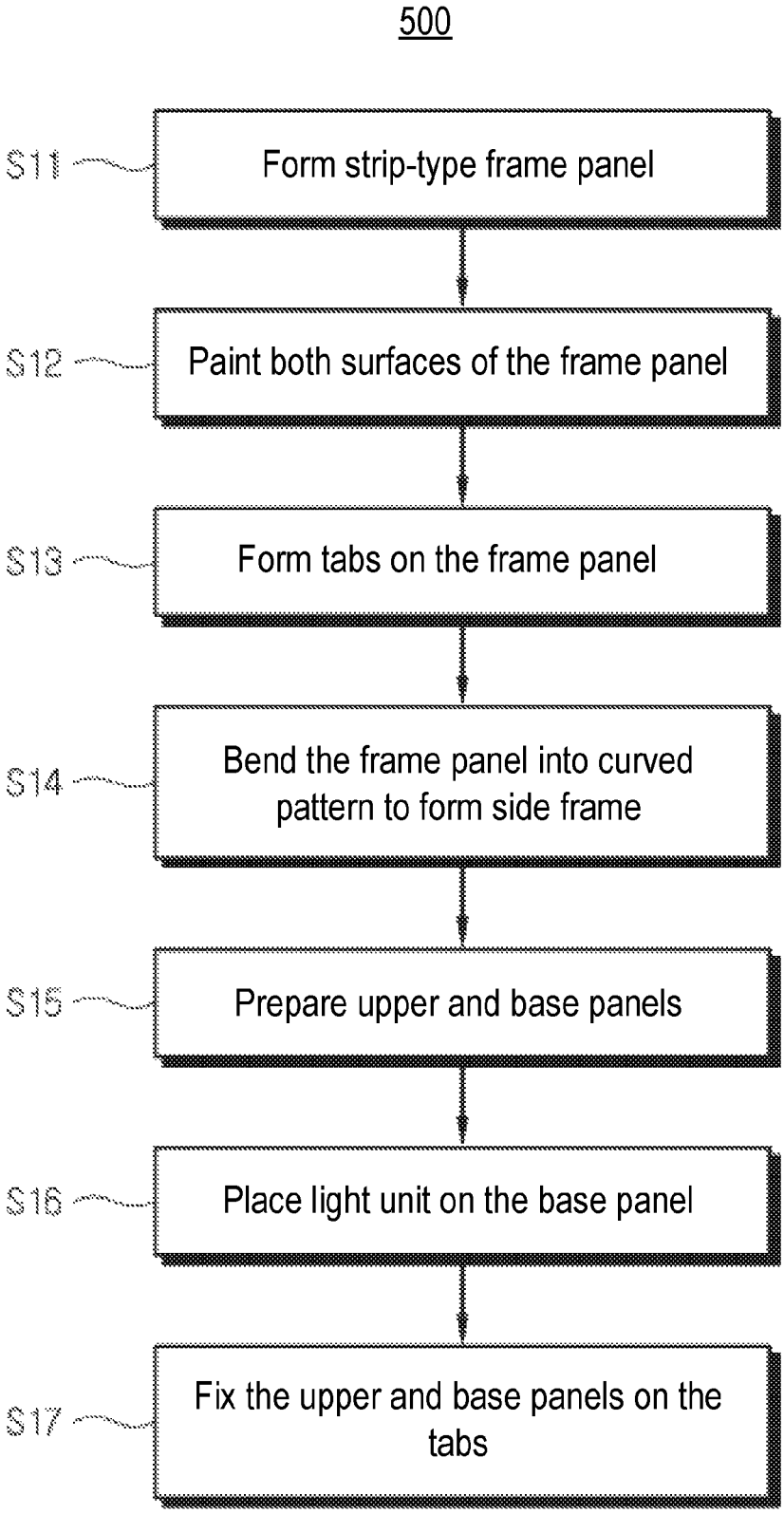
FIG. 5 is a flow diagram illustrating a process for assembling the three-dimensional sign in accordance with one embodiment of the present disclosure.

FIG. 5 is a flow diagram illustrating a process 500 for assembling the three-dimensional sign in accordance with one embodiment of the present disclosure. The process 500 includes forming a strip-type frame panel, at block S11. Both surfaces of the frame panel is then painted, at block S12. The tabs are formed on the frame panel, at block S13. At block S14, the frame panel is bent into a curved pattern to form a side frame. The upper and base panels are then prepared, at block S15. The light unit is place on the base panel, at block S16, and the upper and base panels are fixed on the tabs, at block S17.

The above descriptions of the disclosed embodiments are provided to enable any person skilled in the art to make or use the disclosure. Various modifications to these embodiments will be readily apparent to those skilled in the art, and the generic principles described herein can be applied to other embodiments without departing from the spirit or scope of the disclosure. Thus, it will be understood that the description and drawings presented herein represent embodiments of the disclosure and are therefore representative of the subject matter which is broadly contemplated by the present disclosure. It will be further understood that the scope of the present disclosure fully encompasses other embodiments that may become obvious to those skilled in the art and that the scope of the present disclosure is accordingly limited by nothing other than the appended claims.

What is claimed is:

1. A three-dimensional signage display, comprising:

a frame panel having a predetermined width, the frame panel configured to be bent and shaped into a side frame with a desired pattern;

an upper panel configured to cover a first opening of the side frame;

at least one tab formed along a longitudinal direction of the frame panel, wherein the at least one tab is formed with polymer material, wherein the upper panel is formed with same material as the at least one tab.

2. The display of claim 1, wherein the frame panel is a strip type panel.

3. The display of claim 1, wherein the frame panel is configured as a wound coil.

4. The display of claim 1, wherein the desire pattern forms a character.

5. The display of claim 1, wherein the desire pattern forms a figure.

6. The display of claim 1, wherein the at least one tab is formed on a first surface of the frame panel.

7. The display of claim 1, wherein the at least one tab comprises two tabs, one on each end of the first surface of the frame panel.

8. The display of claim 1, further comprising a base panel configured to cover a second opening of the side frame.

9. The display of claim 8, wherein the at least one tab near the second opening is formed with dark material.

10. The display of claim 8, further comprising an attachment means for fixing periphery of the upper panel and the base panel to the at least one tab.

11. The display of claim 8, further comprising a lighting unit disposed on the base panel, the lighting unit configured to radiate light toward the upper panel.

12. The display of claim 11, wherein the lighting unit includes a light-emitting diode.

13. The display of claim 1, wherein the upper panel is formed with one of polycarbonate or acrylic material.

14. The display of claim 1, wherein the at least one tab is formed with polyvinyl chloride (PVC) material.

15. The display of claim 1, wherein the polymer material is a soft polymer for easy bending.

16. A three-dimensional signage display, comprising:

a frame panel having a predetermined width, the frame panel configured to be bent and shaped into a side frame with a desired pattern;

an upper panel configured to cover a first opening of the side frame;

at least one tab formed along a longitudinal direction of the frame panel, wherein the at least one tab is formed with polymer material, wherein the at least one tab near the first opening is formed with transparent material.

* * * * *